US006450710B1

(12) United States Patent
Foster et al.

(10) Patent No.: US 6,450,710 B1
(45) Date of Patent: Sep. 17, 2002

(54) FRAME SYSTEM FOR AN INK JET PRINTER

(75) Inventors: Larry Steven Foster; Randall Steven Gall; James Philip Harden, all of Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/616,601

(22) Filed: Jul. 14, 2000

(51) Int. Cl.[7] ..... B41J 11/20

(52) U.S. Cl. ..... 400/58; 400/354; 347/8; 347/37

(58) Field of Search ..... 400/55, 56, 57, 400/352, 354, 355, 58; 347/220, 4, 8, 37, 104, 108

(56) References Cited

U.S. PATENT DOCUMENTS

| | | | | |
|---|---|---|---|---|
| 3,155,032 A | * | 11/1964 | Antonucci | 400/58 |
| 4,365,900 A | * | 12/1982 | Gottsmann et al. | 400/58 |
| 4,462,702 A | * | 7/1984 | Fritz et al. | 400/58 |
| 4,906,115 A | | 3/1990 | Bischof | |
| 5,195,836 A | | 3/1993 | Longust et al. | |
| 5,322,377 A | * | 6/1994 | Asai | 400/58 |
| 5,479,194 A | * | 12/1995 | Hirano et al. | 400/58 |
| 5,672,015 A | * | 9/1997 | Lyerly et al. | 400/58 |
| 5,678,936 A | | 10/1997 | Hino | |
| 5,815,171 A | | 9/1998 | Brugue | |
| 6,027,264 A | | 2/2000 | Maher et al. | |
| 6,092,887 A | * | 7/2000 | Tanino et al. | 347/37 |

FOREIGN PATENT DOCUMENTS

| | | | | |
|---|---|---|---|---|
| EP | 0143467 | * | 6/1985 | 400/58 |

* cited by examiner

*Primary Examiner*—Eugene Eickholt
(74) *Attorney, Agent, or Firm*—Taylor & Aust, P.C.; Ronald K. Aust; Elizabeth C. Jacobs

(57) ABSTRACT

Substantially uniform spacing between a printhead and a platen throughout a print zone associated with said printhead in an ink jet printer is provided. The ink jet printer includes a printer frame, and the platen is slideably coupled to the printer frame. A first carrier guide rod is attached to the printer frame, and a second carrier guide rod has at least one end adjustably attached to the printer frame. A position of the second carrier guide rod is adjusted to provide parallelism between the first carrier guide rod and the second carrier guide rod. The platen is biased to a position relative to a position of at least one of the first carrier guide rod and the second carrier guide rod.

50 Claims, 6 Drawing Sheets

FRAME SYSTEM FOR AN INK JET PRINTER

BACKGROUND OF THE INVENTION

1. Field of the Invention

The present invention relates to an ink jet printer, and, more particularly, to a frame system for an ink jet printer that provides a substantially uniform printhead to print media gap throughout a print zone associated with the ink jet printer.

2. Description of the Related Art

In a typical ink jet printer having a reciprocating printhead, a printhead carriage carrying the printhead is supported by a pair of carrier guide rods which are positioned substantially traverse to a print media path. As a sheet of print media is transported in an indexed manner under the printhead, the printhead is scanned in a reciprocating manner across the width of an image area on the sheet of print media, wherein the path of the reciprocating printhead defines a print zone. A platen is provided opposite to the printhead for contacting the non-printed side of the print media and, in part, defines the distance between the printhead and the sheet of print media.

One important parameter associated with an ink jet printer is the gap between the plane of the nozzle plate of the printhead and the plane of the print media on which the ink expelled from the nozzle plate is deposited. As the gap becomes wider, the error in dot placement increases. The limits on the low end of the gap range is defined by the point at which the printhead actually contacts the media, thereby causing smearing of the freshly deposited ink. In addition, such contact with the print media can result in damage to the printhead such as, for example, by clogging the nozzles of the nozzle plate of the printhead. Thus, it is desirable in a high quality ink jet printer design to control the printhead to print media gap to a minimum value without permitting contact between the printhead and the print media. However, any variation in the parallelism between the two carrier guide rods, and any variation between the parallelism of the platen with respect to the two carrier guide rods, results in variations in the printhead to print media gap along the extent of the print zone.

What is needed in the art is a frame system for an ink jet printer that provides for a substantially uniform and adjustable printhead to platen gap throughout the print zone, and in turn provides for a substantially uniform printhead to print media gap throughout the print zone.

SUMMARY OF THE INVENTION

The present invention provides a frame system for an ink jet printer that provides for a substantially uniform and adjustable printhead to platen gap throughout the print zone, and in turn provides for a substantially uniform printhead to print media gap throughout the print zone.

The invention comprises, in one form thereof, an ink jet printer having a print zone defined by the travel of a printhead, having a media path defined to extend through the print zone and having a media feed direction. The ink jet printer includes a printer frame, and a first guide rod mounted to printer frame. A platen having a media carrying side is positioned to face the printhead, and the media carrying side is positioned along the media path. The platen has a first end located on a first side of the media path and a second end located on a second side of the media path opposite to the first side of the media path. A first stop mechanism is attached to the printer frame and a second stop mechanism is attached to the printer frame, the second stop mechanism being spaced apart from the first stop mechanism. A first pivot plate is attached to the first end of the platen, the first pivot plate including a first pivot member and a first stop surface, the first pivot plate being slideably coupled to the printer frame. A second pivot plate is attached to the second end of the platen, the second pivot plate including a second pivot member and a second stop surface, the second pivot plate being slideably coupled to the printer frame. A biasing unit provides a biasing force to position and hold the first pivot member and the second pivot member in contact with a surface of the first guide rod, to position and hold the first stop surface in contact with the first stop mechanism and to position and hold the second stop surface in contact with the second stop mechanism.

According to one method of the invention, substantially uniform spacing is provided between a printhead and a platen throughout a print zone associated with the printhead in an ink jet printer, the ink jet printer including a printer frame and the platen being slideably coupled to the printer frame. The method includes the steps of providing a first carrier guide rod attached to the printer frame; providing a second carrier guide rod having at least one end adjustably attached to the printer frame; adjusting a position of the second carrier guide rod to provide parallelism between the first carrier guide rod and the second carrier guide rod; and biasing the platen to a position relative to a position of at least one of the first carrier guide rod and the second carrier guide rod.

In preferred embodiments, for example, the first guide rod is fixedly attached to the printer frame, such as for example, by welding the first guide rod to the printer frame.

An advantage of the present invention is that the relationship of the printhead to the surface of the media in the print zone can be controlled to minimize the printhead to print media gap.

Another advantage of the present invention is that a robust printer frame structure is provided that minimizes the twist of the carrier during printing and resists the adverse affects of external forces acting on the printer frame that would twist the carrier guide rods out of parallel.

Yet another advantage is that the gap between the printhead and the platen is maintained substantially uniform throughout the extent of the print zone, and as a result, the gap between the printhead and the print media is maintained substantially uniform throughout the extent of the print zone.

Yet another advantage is that the invention ensures perpendicularity between the media path and the printhead scan path.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
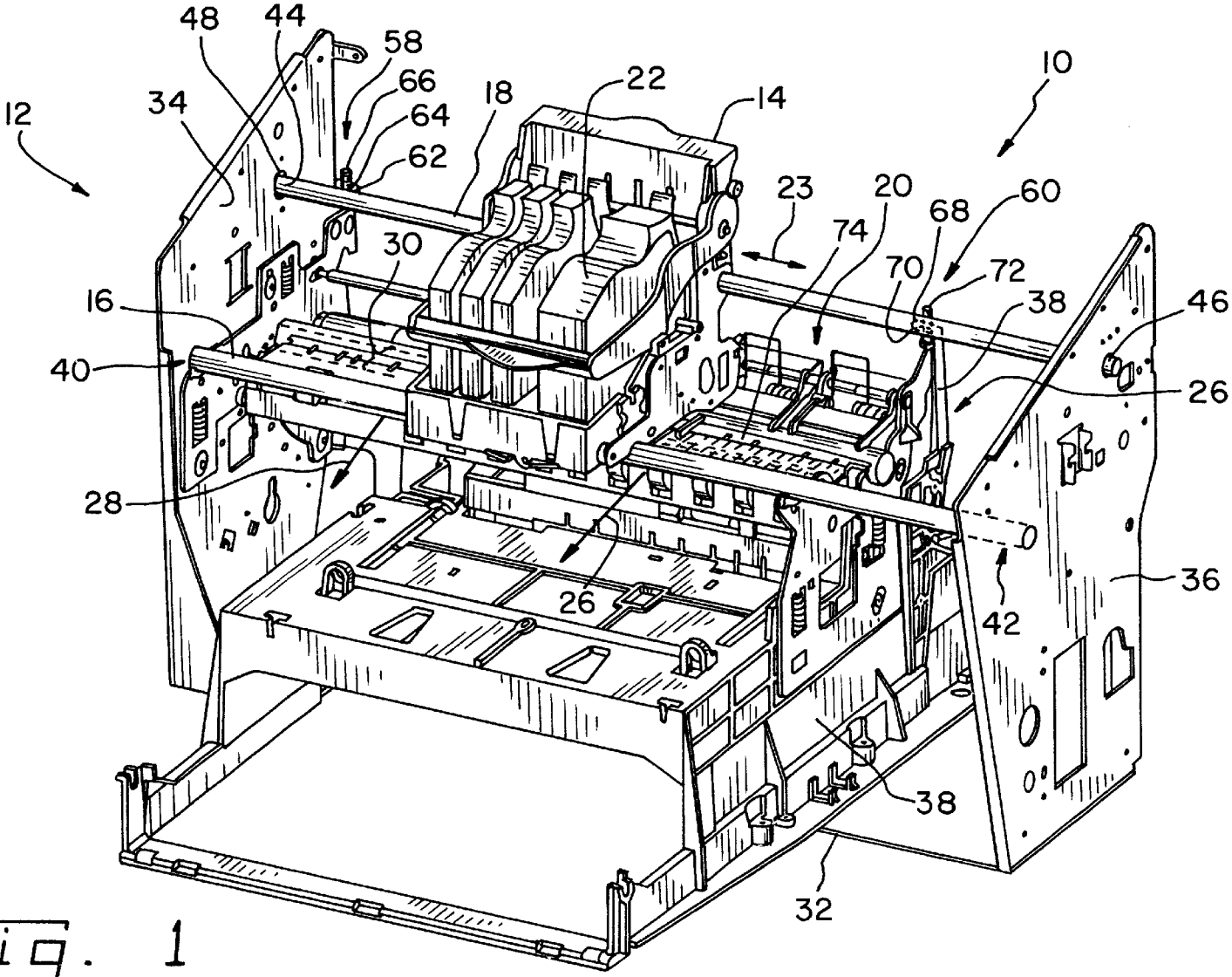
FIG. 1 is a perspective view of an ink jet printer embodying the present invention.
Figure 2:
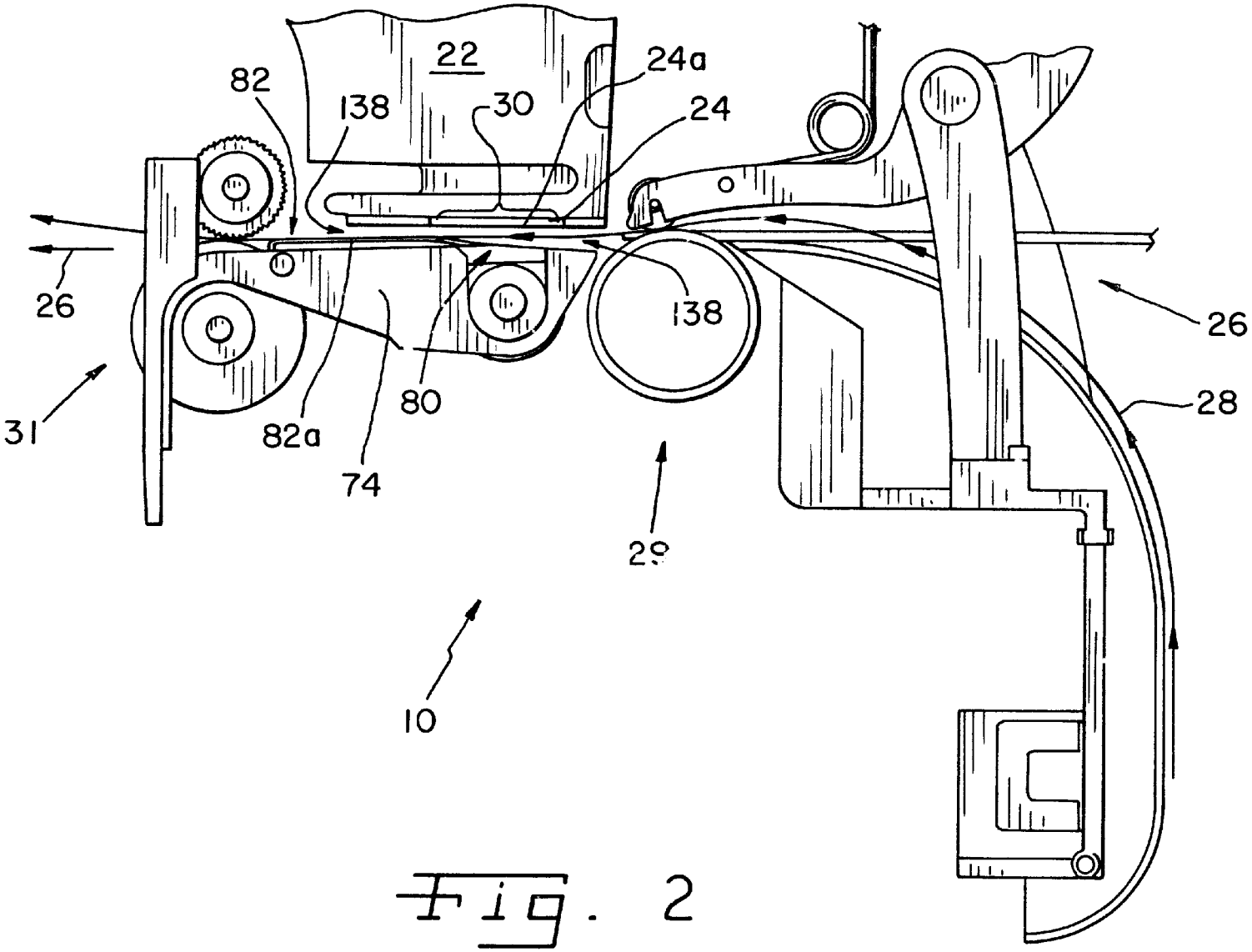
FIG. 2 is a partial side schematic view of the inkjet printer of FIG. 1.

Referring now to the drawings and particularly to FIGS. 1 and 2, there is shown an ink jet printer 10 including a printer frame 12, a printhead carriage 14, a pair of carrier guide rods 16, 18 and a platen assembly 20. Printhead carriage 14 is driven by a carriage drive system (not shown) to carry a printhead cartridge 22 in a reciprocating manner in a bi-directional path 23 defined by the orientation of carrier guide rods 16, 18. Referring to FIG. 2, printhead cartridge 22 includes a printhead 24 having a surface including a nozzle plate 24*a* containing a plurality of nozzles for controllably expelling ink droplets onto a sheet of print media. During a printing operation, print media is transported in a manner known in the art along a media path 26 in a media feed direction, as depicted by arrowed line 28, past printhead 24. The bi-directional path traveled by printhead 24 defines a print zone 30. Also shown in FIG. 2 is a feed roller assembly 29 for indexing a sheet of print media past printhead 24, and an exit roller assembly 31 for advancing a printed sheet out of ink jet printer 10.

As shown in FIG. 1, printer frame 12 includes a base 32, a first side frame 34, a second side frame 36 and an intermediate side frame 38. Each of side frames 34, 36 and 38 are attached to base 32, wherein first side frame 34 is spaced apart from second side frame 36, and intermediate side frame 38 is positioned between first side frame 34 and second side frame 36. In the embodiment shown, carrier guide rods 16, 18 extend between first and second side frames 34, 36 and are positioned substantially above and transverse to media path 26. More particularly, carrier guide rod 16 is located downstream from print zone 30 and carrier guide rod 18 is located upstream from print zone 30, wherein the terms upstream and downstream are used in relation to media feed direction 28.

Carrier guide rod 16 preferably is made of steel and has a diameter of about 12 millimeters. Carrier guide rod 16 has a first end 40 and a second end 42, wherein first end 40 is fixedly attached to first side frame 34 and second end 42 is fixedly attached to second side frame 36. Preferably, the fixed attachment is achieved by welding each end 40, 42 of carrier guide rod 16 to the respective side frames 34, 36. Alternatively, such fixed attachment can achieved using fasteners which, when engaged, prohibit the movement of carrier rod 16 independently from first and second side frames 34, 36 of inkjet printer 10.

Figure 3:
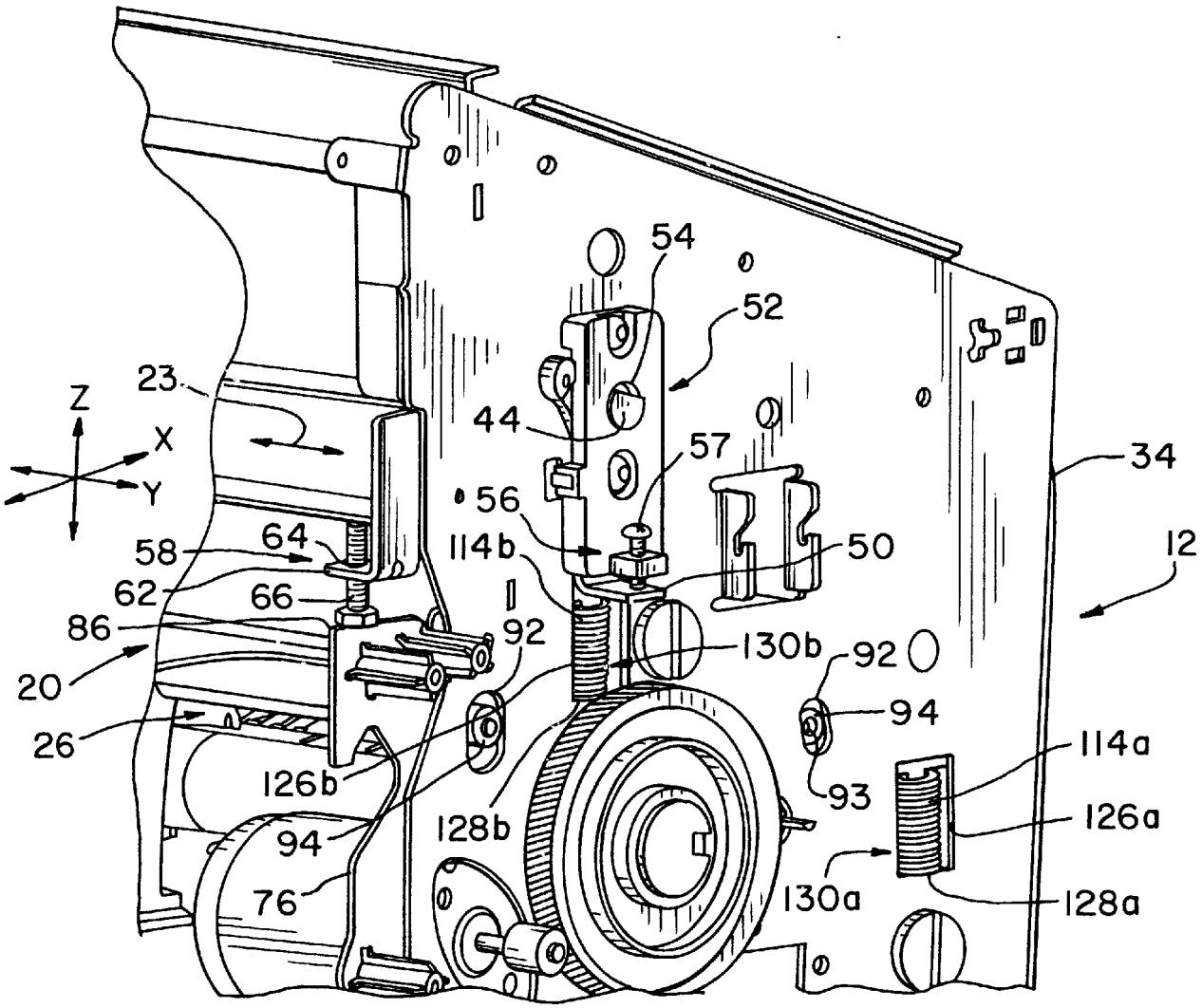
FIG. 3 is a partial perspective view of the inkjet printer of FIG. 1.

Carrier guide rod 18 also preferably is made of steel, and may be sized to have a diameter smaller than the diameter of carrier guide rod 16, such as for example, having a diameter of about 8 millimeters. Carrier guide rod 1S has a first end 44 and a second end 46, wherein first end 44 is adjustably attached to first side frame 34 and second end 46 is secured to second side frame 36. Second end 46 may be secured to second side frame 36 by a feature, such as an indentation or opening, formed in second side frame 36, or alternatively, by fixed attachment. First side frame 34 includes a hole 48 for receiving first end 44 of carrier guide rod 18 and, as shown in FIG. 3, an outwardly extending adjustment tab 50. A rod position adjustment mechanism 52 is attached to first side frame 34. Rod position adjustment mechanism 52 includes an aperture 54 and an adjuster 56. Aperture 54 is positioned in alignment with hole 48 for receiving first end 44 of carrier guide rod 18. As shown, adjuster 56 includes a screw 57 that engages adjustment tab 50 for effecting a change of position of first end 44 of carrier guide rod 18, and preferably, for effecting a change in the vertical position of first end 44 of carrier guide rod 18. In particular, adjuster 56 is manipulated to provide parallelism between carrier guide rod 18 and carrier guide rod 16.

Figure 6:
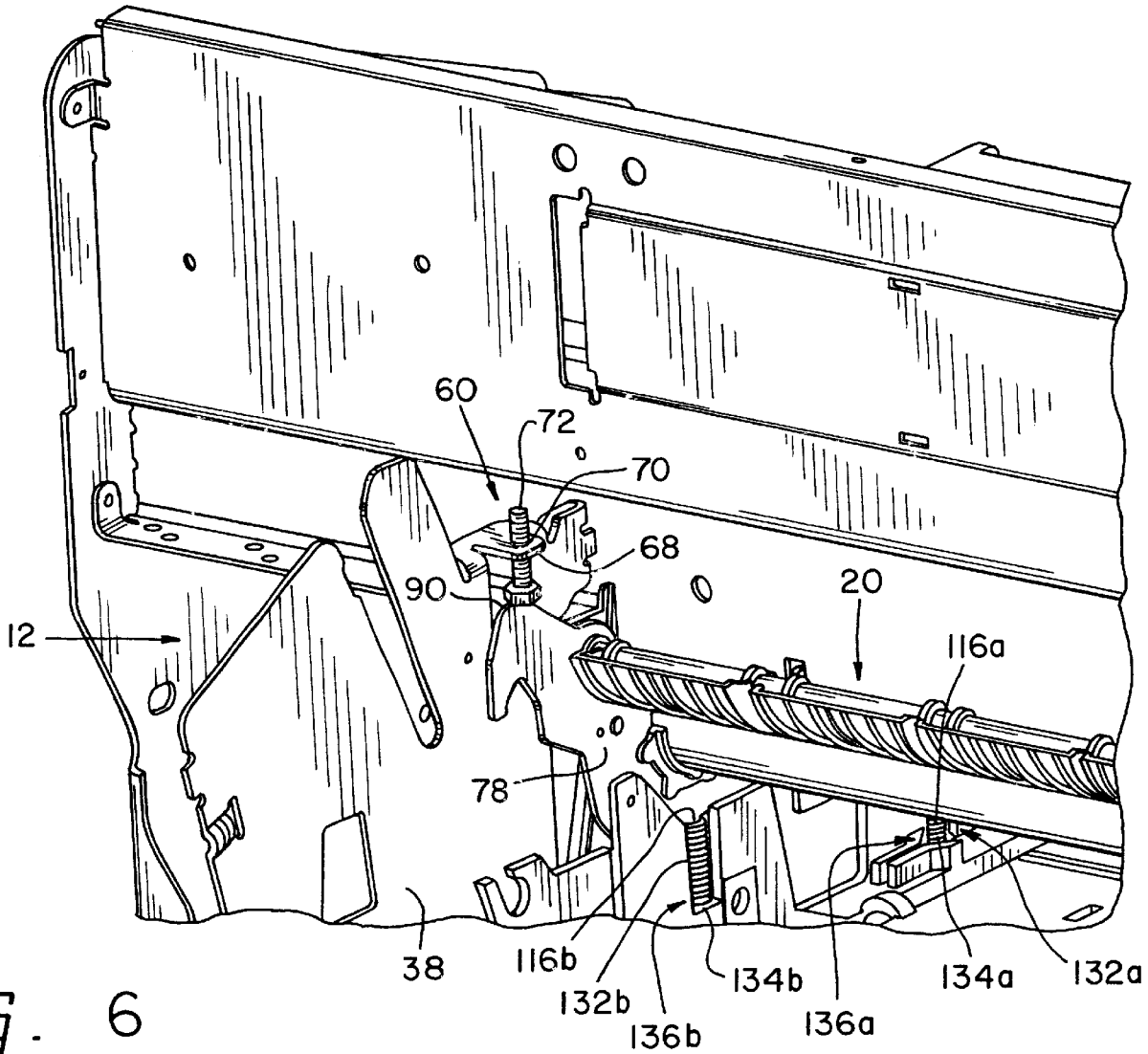
FIG. 6 is a partial perspective view showing the relationship between the intermediate side frame and the corresponding pivot plate of the platen assembly of the present invention.

Referring to FIGS. 1, 3 and 6, a stop mechanism 58 is attached to first side frame 34 and a stop mechanism 60 is attached to intermediate side frame 38. Stop mechanism 58 includes a tab 62 attached to and extending perpendicularly from first side frame 34. Tab 62 includes a threaded hole 64 for receiving a threaded screw, or bolt, 66. Likewise, stop mechanism 60 includes a tab 68 attached to and extending perpendicularly from intermediate side frame 38. Tab 68 includes a threaded hole 70 for receiving a threaded screw, or bolt, 72.

Figure 4:
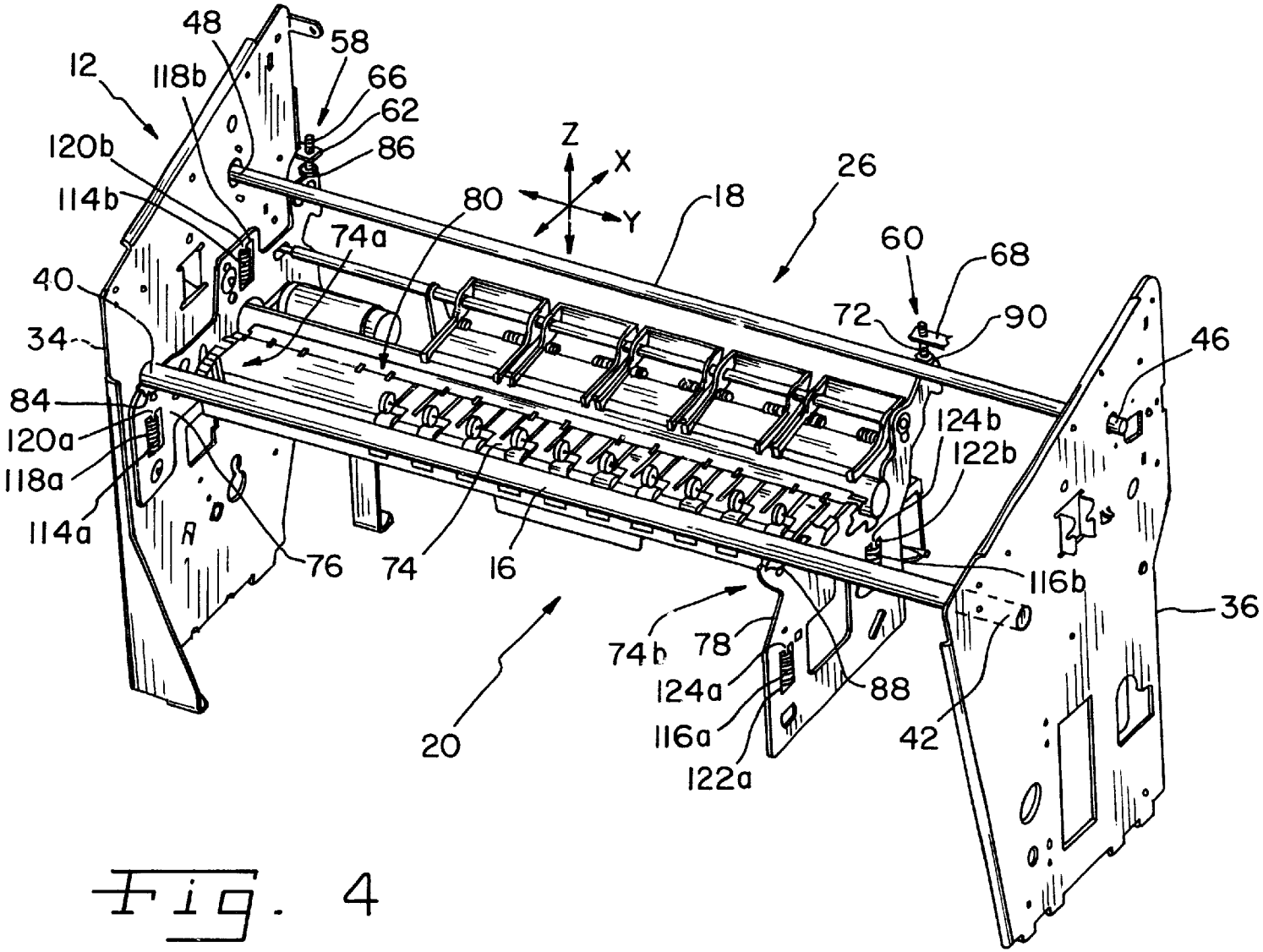
FIG. 4 is a perspective view of the ink jet printer of FIG. 1 wherein the carrier, base and intermediate frame have been removed to more clearly show the platen assembly of the present invention.

Referring now to FIG. 4, platen assembly 20 includes a platen 74, a first pivot plate 76 and a pivot plate 78. Platen 74 is positioned between first side frame 34 and intermediate side frame 38 (see FIG. 1), wherein at least a portion 80 of platen 74 is positioned in print zone 30 opposite to printhead 24 (see FIG. 2). Platen 74 includes a media carrying side 82 positioned along media path 26, and includes a plurality of ribs 82*a* that contact a non-printed side of a sheet of print media being transported past printhead 24. Thus, media carrying side 82 of platen 74 is positioned to face the nozzle plate 24*a* of printhead 24. Referring again to FIG. 4, platen 74 extends transverse to media path 26, wherein platen 74 has a first end 74*a* located on a first side of media path 26 and a second end 74*b* located on a second side of media path 26 opposite to first side of media path 26.

Pivot plate 76 is attached to first end 74*a* of platen 74. Pivot plate 76 includes a pivot member 84 and a stop surface 86. Pivot plate 76 is slideably coupled to first side frame 34 to permit movement of first end of platen 74 in relation to first side frame 34.

Pivot plate 78 is attached to second end 74*b* of platen 74. Pivot plate 78 includes a pivot member 88 and a stop surface 90. Pivot plate 78 is slideably coupled to intermediate side frame 38 to permit movement of second end of platen 74 in relation to intermediate side frame 38.

While pivot plates 76, 78 have been described as being attached to platen 74, those skilled in the art will recognize that it is possible to combine pivot plates 76, 78 with platen 74 to form an integral structure, such as by molding or casting platen assembly 20 as a single unitary structure. Accordingly, in the present instance, the term "attachment" is intended to include integral formation.

The slideable coupling of pivot plate 76 to first side frame 34 and the slideable coupling of pivot plate 78 to intermediate side frame 38 is achieved, as shown by example in FIG. 3, by providing slots 92 in each of side frames 34, 38 and by providing corresponding protruding lugs 94 which extend from each of pivot plates 76, 78 which are received in the respective slots 92. One or more of the lugs 94 can include a threaded hole 93 for receiving a screw (not shown) so as to limit the travel of platen 74 between first side frame 34 and intermediate side frame 38 in the y dimension, i.e., in a direction transverse to media path 26.

Figure 5:
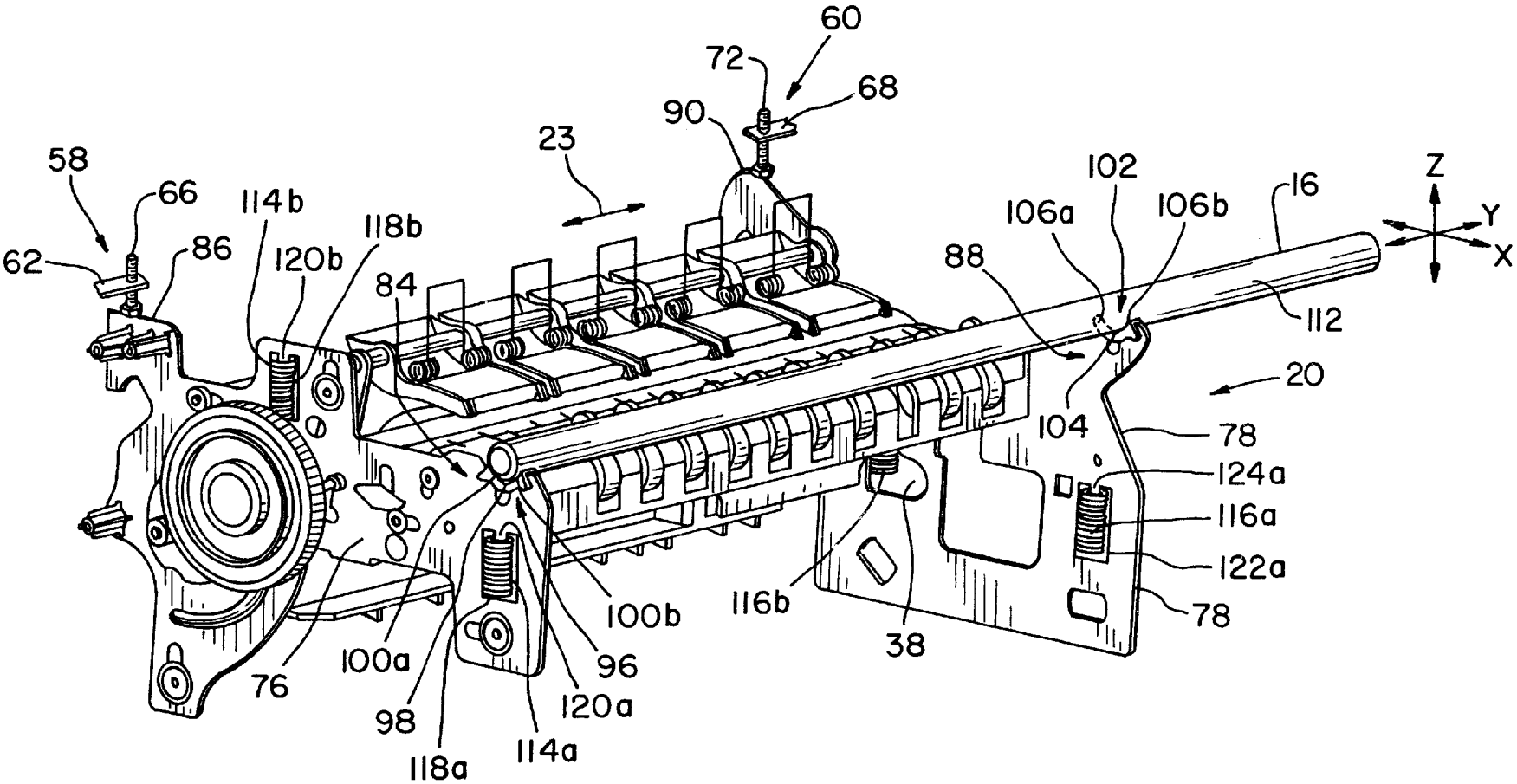
FIG. 5 is a perspective view of a portion of the ink jet printer of FIG. 1 showing in further detail the pivot plates of the platen assembly of the present invention.

Referring now to FIG. 5, pivot member 84 includes an open-faced bearing structure 96 defining a bearing surface 98 having at least two separated regions 100*a*, 100*b*. Pivot member 88 includes an open-faced bearing structure 102 defining a bearing surface 104 having at least two separated regions 106*a*, 106*b*. As shown in FIG. 5, an open region of each of the open-faced bearing structures 96, 102 is positioned to face carrier guide rod 16. Preferably, each of bearing surface 98 and bearing surface 104 is configured to have a substantially V-shaped cross-section, and is sized to permit the engagement of the separated regions 100*a*, 100*b* and 106*a*, 106*b* with a surface 112 of carrier guide rod 16 upon the upward movement of pivot plates 76, 78. It should be noted that the engagement ol the V-shaped bearing surfaces 98, 104 with carrier guide rod 16 limits the movement of platen 74 in two dimensions, i.e., the x and z dimensions.

As shown in FIGS. 3–5, a set of biasing members 114*a*, 114*b* are coupled between pivot plate 76 and first side frame 34, wherein each of biasing members 114*a* and 114*b* exert a force between pivot plate 76 and first side frame 34 to position and hold bearing surface 98 of pivot member 84 in contact with carrier guide rod 16 and to position and hold stop surface 86 in contact with stop mechanism 58.

Referring to FIGS. 4–6, a set of biasing members 116*a*, 116*b* are coupled between pivot plate 76 and intermediate side frame 38, wherein biasing members 116*a*, 116*b* exert a force between pivot plate 78 and intermediate side frame 38 to position and hold bearing surface 104 of pivot member 88 in contact with carrier guide rod 16 and to position and hold stop surface 90 in contact with stop mechanism 60.

Preferably, each of biasing members 114*a*, 114*b* and biasing members 116*a*, 116*b* is a coil spring held in a state of compression between the platen assembly 20 and the printer frame 12. As shown in FIGS. 4 and 5, pivot plate 76 has a first set of U-shaped slots 118*a*, 118*b* defining elongated portions 120*a*, 120*b*, respectively, and coil springs 114*a*, 114*b* are positioned over elongated portions 120*a*, 120*b*, respectively, and in U-shaped slots 118*a*, 118*b*, respectively. Likewise, pivot plate 78 has a second set of U-shaped slots 122*a*, 122*b* defining elongated portions 124*a*, 124*b*, respectively, and coil springs 116*a*, 116*b* are positioned over elongated portions 124*a*, 124*b*, respectively, and in U-shaped slots 122*a*, 122*b*, respectively.

As shown in FIG. 3, first side frame 34 includes a pair of voids 126*a*, 126*b* for receiving a portion of coil spring 114*a*, 114*b* wherein the voids 126*a*, 126*b* each define a contact surface 128*a*, 128*b* which is engaged by a first end portion 130*a*, 130*b* of coil springs 114*a*, 114*b*, respectively. Likewise, as shown in FIG. 6, intermediate side frame 38 includes a pair of voids 132*a*, 132*b* for receiving a portion of coil springs 116*a*, 116*b*, wherein the voids 132*a*, 132*b* each define a contact surface 134*a*, 134*b*, respectively, which is engaged by end portions 136*a*, 136*b* of coil springs 116*a*, 116*b*, respectively. Thus, coil springs 114*a*, 114*b*, 116*a*, 116*b* provide an urging force, wherein platen 74 is moved in a generally upward direction. However, the upward movement of platen 74 is limited by stop mechanisms 58, 60 and carrier guide rod 16.

Once assembled, the invention provides for establishing adjustable and substantially uniform spacing between printhead 24 and platen 74 throughout print zone 30, and in turn, provides adjustable and substantially uniform spacing between printhead nozzle plate 24*a* and the print side of a sheet of print media. In addition, the invention ensures perpendicularity between media path 26 and the scan path, i.e., bi-directional path 23, of printhead 24. First, a position of carrier guide rod 18 is adjusted to provide parallelism between carrier guide rod 16 and carrier guide rod 18 by manipulating adjuster 56, i.e., by rotating the adjustment screw 57, of rod position adjustment mechanism 52 (see FIG. 3). Thereafter, stop mechanism 58 and stop mechanism 60 are independently adjusted by rotation of the respective adjustment screws 66, 72 (see FIGS. 3, 4 and 6) to define a height of a gap 138 (see FIG. 2) between platen 74 and printhead 24 throughout print zone 30, and in turn, to define the gap between printhead nozzle plate 24*a* of printhead 24 and the print side of the print media in print zone 30 when a sheet of print media is being transported in media path 26 through print zone 30.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An ink jet printer having a print zone defined by the travel of a printhead, having a media path defined to extend through said print zone and having a media feed direction, comprising:

a printer frame;

a first guide rod mounted to said printer frame;

a platen having a media carrying side positioned to face said printhead, and said media carrying side being positioned along said media path, said platen having a first end located on a first side of said media path and a second end located on a second side of said media path opposite to said first side of said media path;

a first stop mechanism attached to said printer frame;

a second stop mechanism attached to said printer frame, said second stop mechanism being spaced apart from said first stop mechanism;

a first pivot plate attached to said first end of said platen, said first pivot plate including a first pivot member and a first stop surface, said first pivot plate being slideably coupled to said printer frame;

a second pivot plate attached to said second end of said platen, said second pivot plate including a second pivot member and a second stop surface, said second pivot plate being slideably coupled to said printer frame; and a biasing unit for providing a biasing force to position and hold said first pivot member and said second pivot member in contact with a surface of said first guide rod, to position and hold said first stop surface in contact with said first stop mechanism and to position and hold said second stop surface in contact with said second stop mechanism.

2. The ink jet printer of claim 1, wherein said first pivot member comprises a first open-faced bearing structure defining a first bearing surface having at least two separated regions each of which contact said surface of said first guide rod, and wherein said second pivot member comprises a second open-faced bearing structure defining a second bearing surface having at least two separated regions each of which contact said surface of said first guide rod.

3. The ink jet printer of claim 2, wherein each of said first bearing surface and said second bearing surface is configured to have a substantially V-shape.

4. The ink jet printer of claim 2, wherein an open region of each of said first open-faced bearing structure and said second open-faced bearing structure is positioned to face upwardly.

5. The ink jet printer of claim 1, wherein said first stop mechanism and said second stop mechanism are adjustable to define a height of a gap between said platen and said printhead in said print zone.

6. The ink jet printer of claim 5, wherein each of said first stop mechanism and said second stop mechanism are independently adjustable.

7. The ink jet printer of claim 1, wherein each of said first stop mechanism and said second stop mechanism comprise an adjustment screw which is rotatable to adjust a height of a gap between said platen and said printhead in said print zone.

8. The ink jet printer of claim 1, wherein said biasing unit comprises a first biasing member and a second biasing member.

9. The ink jet printer of claim 8, wherein said platen is moved in a generally upward direction by the force exerted by each of said first biasing member and said second biasing member.

10. The inkjet printer of claim 9, wherein said first biasing member comprises at least a first coil spring and wherein said first pivot plate has a first U-shaped slot defining a first elongated portion, said first coil spring being positioned over said first elongated portion and in said first U-shaped slot.

11. The ink jet printer of claim 10, wherein said printer frame includes a first void for receiving a portion of said first coil spring, said first void defining a first contact surface which is engaged by a first end portion of said first coil spring.

12. The ink jet printer of claim 10, wherein said second biasing member comprises at least a second coil spring, said second pivot plate having a second U-shaped slot defining a second elongated portion and said second coil spring being positioned over said second elongated portion and in said second U-shaped slot.

13. The ink jet printer of claim 12, wherein said printer frame includes a first void defining a first contact surface which is engaged by a first end portion of said first coil spring, and wherein said printer frame includes a second void defining a second contact surface which is engaged by a second end portion of said second coil spring.

14. The inkjet printer of claim 1, wherein said first guide rod has a first end and a second end, and wherein each of said first end and said second end is fixedly attached said printer frame.

15. The ink jet printer of clam 1, wherein said first guide rod has a first end and a second end, and wherein each of said first end and said second end is welded to said printer frame.

16. The ink jet printer of claim 1, further comprising a second guide rod having a first end and a second end, and wherein said first end is adjustably attached to said printer frame and said second end is secured to said printer frame.

17. The ink jet printer of claim 16, wherein said printer frame includes a hole for receiving said first end of said second guide rod, said ink jet printer further comprising an adjustment mechanism attached to said printer frame, said adjustment mechanism including an aperture for receiving said first end of said second guide rod and an adjuster for effecting a change of position of said first end of said second guide rod.

18. The inkjet printer of claim 17, wherein said adjuster is manipulated to provide parallelism between said second guide rod and said first guide rod.

19. The inkjet printer of claim 17, wherein said adjuster comprises an adjustment screw, wherein a rotation of said screw effects a change of vertical position of said first end of said second guide rod.

20. The inkjet printer of claim 19, wherein said adjuster is manipulated to provide parallelism between said second guide rod and said first guide rod, and between said second guide rod and said platen.

21. A method for providing substantially uniform spacing between a printhead and a platen throughout a print zone associated with said printhead in an ink jet printer, said ink jet printer including a printer frame and said platen being slideably coupled to said printer frame, said method comprising the steps of:

providing a first carrier guide rod attached to said printer frame;

providing a second carrier guide rod having at least one end adjustably attached to said printer frame;

adjusting a position of said second carrier guide rod to provide parallelism between said first carrier guide rod and said second carrier guide rod; and biasing said platen to a position relative to a position of at least one of said first carrier guide rod and said second carrier guide rod.

22. The method of claim 21, further comprising the step of:

providing a gap adjustment mechanism for adjusting a gap between said printhead and said platen.

23. The method of claim 21, further comprising the steps of:

providing a first gap adjustment mechanism;

providing a second gap adjustment mechanism separated a distance from said first gap adjustment mechanism; and independently adjusting said first gap adjustment mechanism and said second gap adjustment mechanism to obtain the desired gap between said printhead and said platen throughout said print zone.

24. The method of claim 21, further comprising the step of:

providing in association with said platen a positioning mechanism which engages a surface of said first carrier guide rod upon execution of the biasing step.

25. The method of claim 21, wherein the biasing step includes providing at least one open-faced bearing having a bearing surface which contacts said first carrier guide rod during application of a biasing force.

26. The method of claim 25, wherein said biasing force is applied by a plurality of springs arranged to effect a movement of said platen relative to said printer frame.

27. The method of claim 21, wherein the biasing step includes providing at least two spaced apart open-faced bearings coupled to said platen, each of said at least two spaced apart open-faced bearings having a bearing surface which contacts at least one of said first carrier guide rod and said second carrier guide rod during application of a biasing force.

28. The method of claim 27, wherein said biasing force is applied by a plurality of springs arranged to effect a movement of said platen relative to said printer frame.

29. The method of claim 21, wherein said first carrier guide rod is fixedly attached to said printer frame.

30. The method of claim 21, wherein said first carrier guide rod is welded to said printer frame.

31. An ink jet printer having a print zone defined by the travel of a printhead, having a media path defined to extend through said print zone and having a media feed direction, comprising:

a printer frame including a first side frame, a second side frame and an intermediate side frame, said first side frame being spaced apart from said second side frame and said intermediate side frame being positioned between said first side frame and said second side frame;

a first stop mechanism attached to said first side frame and a second stop mechanism attached to said intermediate side frame;

a first guide rod extending between said first side frame and said second side frame, said first guide rod positioned above said media path and located downstream from said print zone;

a second guide rod extending between said first side frame and said second side frame, said second guide rod positioned above said media path and located upstream from said print zone;

a platen positioned between said first side frame and said intermediate side frame, wherein at least a portion of said platen is positioned in said print zone to face said printhead, said platen including a media carrying side positioned along said media path, said platen having a first end located on a first side of said media path and a second end located on a second side of said media path opposite to said first side of said media path;

a first pivot plate attached to said first end of said platen, said first pivot plate including a first pivot member and a first stop surface, said first pivot plate being slideably coupled to said first side frame;

a first biasing member coupled between said first pivot plate and said first side frame, wherein said first biasing member exerts a force between said first pivot plate and said first side frame to position and hold said first pivot member in contact with said first guide rod and to position and hold said first stop surface in contact with said first stop mechanism;

a second pivot plate attached to said second end of said platen, said second pivot plate including a second pivot member and a second stop surface, said second pivot plate being slideably coupled to said intermediate side frame; and a second biasing member coupled between said second pivot plate and said intermediate side frame, wherein said second biasing member exerts a force between said second pivot plate and said intermediate side frame to position and hold said second pivot member in contact with said first guide rod and to position and hold said second stop surface in contact with said second stop mechanism.

32. The ink jet printer of claim 31, wherein said first pivot member comprises a first open-faced bearing structure defining a first bearing surface having at least two separated regions each of which contact a surface of said first guide rod, and wherein said second pivot member comprises a second open-faced bearing structure defining a second bearing surface having at least two separated regions each of which contact said surface of said first guide rod.

33. The ink jet printer of claim 32, wherein each of said first bearing surface and said second bearing surface is configured to have a substantially V-shape.

34. The ink jet printer of claim 32, wherein an open region of each of said first open-faced bearing structure and said second open-faced bearing structure is positioned to face upwardly.

35. The ink jet printer of claim 31, wherein said first stop mechanism and said second stop mechanism are adjustable to define a height of a gap between said platen and said printhead in said print zone.

36. The ink jet printer of claim 35, wherein each of said first stop mechanism and said second stop mechanism are independently adjustable.

37. The inkjet printer of claim 31, wherein each of said first stop mechanism and said second stop mechanism comprise an adjustment screw which is rotatable to adjust a height of a gap between said platen and said printhead in said print zone.

38. The ink jet printer of claim 31, wherein each of said first biasing member and said second biasing member comprise at least one spring held in compression.

39. The inkjet printer of claim 31, wherein said platen is moved in a generally upward direction by the force exerted by each of said first biasing member and said second biasing member.

40. The ink jet printer of claim 31, wherein said first biasing member comprises a first coil spring, said first pivot plate having a first U-shaped slot defining a first elongated portion and said first coil spring being positioned over said first elongated portion and in said first U-shaped slot.

41. The ink jet printer of claim 40, wherein said first side frame includes a first void for receiving a portion of said first coil spring, said first void defining a first contact surface which is engaged by a first end portion of said first coil spring.

42. The ink jet printer of claim 40, wherein said second biasing member comprises a second coil spring, said second pivot plate having a second U-shaped slot defining a second elongated portion and said second coil spring being positioned over said second elongated portion and in said second U-shaped slot.

43. The ink jet printer of claim 42, wherein said first side frame includes a first void defining a first contact surface which is engaged by a first end portion of said first coil spring, and wherein said intermediate side frame includes a second void defining a second contact surface which is engaged by a second end portion of said second coil spring.

44. The inkjet printer of claim 31, wherein said first guide rod has a first end and a second end, and wherein said first end is fixedly attached to said first side frame and said second end is fixedly attached to said second side frame.

45. The ink jet printer of claim 31, wherein said first guide rod has a first end and a second end, and wherein said first end is welded to said first side frame and said second end is welded to said second side frame.

46. The inkjet printer of claim 31, wherein said second guide rod has a first end and a second end, and wherein said first end is adjustably attached to said first side frame and said second end is secured to said second side frame.

47. The inkjet printer of claim 46, wherein said first side frame includes a hole for receiving said first end of said second guide rod, said ink jet printer further comprising an adjustment mechanism attached to said first side frame, said adjustment mechanism including an aperture for receiving said first end of said second guide rod and an adjuster for effecting a change of position of said first end of said second guide rod.

48. The ink jet printer of claim 47, wherein said adjuster is manipulated to provide parallelism between said second guide rod and said first guide rod.

49. The ink jet printer of claim 47, wherein said adjustment mechanism further comprises an adjustment screw, wherein a rotation of said screw effects a change of a vertical position of said first end of said second guide rod.

50. The inkjet printer of claim 31, wherein said first side frame includes a hole for receiving said first end of said second guide rod, and an adjustment tab extending outwardly therefrom, said ink jet printer further comprising an adjustment mechanism attached to said first side member, said adjustment mechanism including a body and an adjuster, said body having an aperture formed therein, said aperture being positioned in alignment with said hole for receiving said first end of said second guide rod, said adjuster having a screw which engages said adjustment tab for effecting a change of position of said first end of said second guide rod.

* * * * *